United States Patent [19]

Lillicrap

[11] Patent Number: 4,805,669

[45] Date of Patent: Feb. 21, 1989

[54] ELECTROMAGNETIC VALVE

[75] Inventor: Douglas C. Lillicrap, Waverton, United Kingdom

[73] Assignee: The Electricity Council, London, United Kingdom

[21] Appl. No.: 192,266

[22] Filed: May 10, 1988

[30] Foreign Application Priority Data

May 11, 1987 [GB] United Kingdom ..... 8711041

[51] Int. Cl.[4] ..... F15C 1/04

[52] U.S. Cl. ..... 137/827; 137/807; 137/811; 164/147.1

[58] Field of Search ..... 137/808, 811, 807, 827, 137/828; 164/147.1

[56] References Cited

U.S. PATENT DOCUMENTS

| | | | |
|---|---|---|---|
| 3,459,205 | 8/1969 | Ziemer et al. | 137/807 |
| 3,701,357 | 10/1972 | Granström et al. | 137/827 |
| 4,108,721 | 8/1978 | Drzewiecki et al. | 137/828 |
| 4,324,266 | 4/1982 | Garnier et al. | 137/827 |
| 4,655,237 | 4/1987 | Gloor et al. | 137/827 |

*Primary Examiner*—A. Michael Chambers

*Attorney, Agent, or Firm*—Beveridge, DeGrandi & Weilacher

[57] ABSTRACT

An electromagnetic valve for use for discharge of molten metal from a container, comprises a main body providing a discharge passage through which, in use, molten metal will flow; and electrical induction coil located about the passage; means to supply an alternating electric current to the coil whereby the coil provides an alternating magnetic field which induces electric currents in any molten metal in the passage; and a center member located in the passage, the arrangement being such that interaction between the magnetic field provided by the coil and the currents induced in the molten metal in the passage provides a force which as it is increased causes the flow rate of the molten metal through the valve to be reduced until the force is sufficient to urge the molten metal away from the wall of the passage until the molten metal is supported on the center member and the flow of molten metal is cut off. The valve is also arranged to provide mixing of molten metal in the discharge passage with that in the container in order to prevent superheating or freezing of metal in the discharge passage.

20 Claims, 2 Drawing Sheets

ELECTROMAGNETIC VALVE

This invention relates to an electromagnetic valve, and particularly to an electromagnetic valve for use for discharge of molten metal from a container.

In GB-A-No. 777213 there is disclosed a method of controlling or preventing the discharge of molten metal from a container through a discharge passage in the container below the level of the molten metal therein, which comprises utilising electromagnetic forced induced in the molten metal by an induction coil disposed around the container to move the molten metal away from the discharge passage in the container. When the coil is not energised the metal flows out of the container through the discharge passage under the action of gravity, but when the coil is energised the molten metal is moved away from the discharge passage and there is no outflow.

In U.S. Pat. No. 4,655,237 there is disclosed a modification of the above arrangement in which a refractory insert is placed in the discharge passage which is itself formed by a refractory tube around which the induction coil is located. When the induction coil is energised the electromagnetic forces exert a braking action on any metal flowing in the discharge passage, thus allowing the flow rate to be regulated. For sufficiently high coil currents the electromagnetic forces constrict the metal to the centre of the passage so that the refractory insert then cuts off the flow entirely. This modification giving the ability to regulate the flow rate and cut if off is an improvement over the valve described in GB-A-No. 777213, but nevertheless the valve described in U.S. Pat. No. 4,655,237 suffers from a number of disadvantages.

To cut off the flow of molten metal against the pressure due to the depth of metal above the valve, requires a high magnetic field strength. For ferrous alloys the magnetic induction at the edge of the metal stream will need to be $\frac{1}{3}$ Tesla or greater for most typical applications. Furthermore, there is a necessary relationship between the frequency of the coil current and the dimensions of the insert. For any practical valve the frequency will be many kilohertz. This combination of high field strength and high frequency causes a high induced power in the column of metal within the discharge passage. Thus, in the stream shut off situation, the relatively small amount of metal in the dicharge passage will rapidly superheat to an unacceptably high temperature that will cause rapid failure of the refractory parts of the valve. In the valve disclosed in U.S. Pat. No. 4,655,237 the discharge passage is long and narrow, making it virtually impossible to produce effective convective heat transfer along the passage, which would dissipate the excess heat by mixing the superheated metal with cooler metal in the container above the valve.

According to this invention there is provided an electromagnetic valve for use for discharge of molten metal from a container, comprising a main body providing a discharge passage through which, in use, molten metal will flow from a container under the action of gravity; an electrical induction coil located about the passage; means to supply an alternating electric current to the coil whereby the coil provides an alternating magnetic field which induces electric currents in any molten metal in the passage; and a centre member located in the passage, the arrangement being such that interaction between the magnetic field provided by the coil and the currents induced in the molten metal in the passage provide a force which as it is increased causes the flow rate of the molten metal through the valve to be reduced until the force is sufficient to urge the molten metal away from the wall of the passage until the molten metal is supported on the top of the centre member and the flow of molten metal is cut off, in which the length of the passage above the top of the centre member is less than the diameter thereof, and the passage opens into the container by way of a funnel shaped surface whereby the force provided by the interaction between the magnetic field of the coil and the currents induced in the molten metal, sets up a vortex movement in the molten metal above the center member when the flow is cut off such that the molten metal in the passage is mixed with that in the container.

A further disadvantage of the valve described in U.S. Pat. No. 4,655,237 is that the metal flows around the top of the insert into an annular space and then flows through four relatively small holes back into a central channel. Apart from the obvious risk of the holes becoming blocked by slag or of metal freezing in them, it has been found that the arrangement produces a broken and erratic stream of metal. This is particularly so when the flow rate is being throttled and the holes and central channel are only partially filled with metal. Under these conditions a spray of droplets can be produced in the central channel where the streams from the holes meet. Unless precautions are taken, the large surface area of the doplets leads to a high rate of oxidation of the falling stream. In the valve of U.S. Pat. No. 4,655,237 the stream is shrouded with a refractory tube to minimise oxidation, but there a numerous circumstances where this would not be convenient. For example, it would be extremely difficult to fit a shroud when pouring metal into moulds on an automatic casting line, and yet, under these circumstances, a stream which tended to break up into droplets would be totally unacceptable.

According to this invention there is provided an electromagnetic valve for use for discharge of molten metal from a container, comprising a main body providing a discharge passage through which, in use, molten metal will flow from a container under the action of gravity; an electrical induction coil located about the passage; means to supply an alternating electric current to the coil whereby the coil provides an alternating magnetic field which induces electric currents in any molten metal in the passage; and a centre member located in the passage and shaped such that the passage has an upper circular cross-section parallel sided portion leading to an asymmetric outwardly tapering conical portion which in turn leads to a lower smaller diameter circular cross-section portion the axis of which is offset in relation to that of the upper portion, the centre member having a flat top located at the junction between the upper and conical portions of the passage and being supported by a single web extending from the main body, the arrangement being such that interaction between the magnetic field provided by the coil and the currents induced in the molten metal in the passage provide a force which as it is increased causes the flow rate of the molten metal through the valve to be reduced until the force is sufficient to urge the molten metal away from the wall of the passage until the molten metal is supported on the flat top of the centre member and the flow of molten metal is cut off.

Such a valve has the advantage that a single stream of molten metal issues from the valve for all molten metal flow rates.

This invention will now be described by way of example with reference to the drawings, in which.

Figure 2:
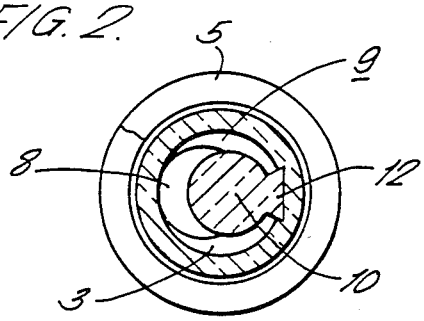
FIG. 2 is a plan view of the valve of FIG. 1.

The valve has a main body 1 of refractory material having an upper face 2 defining a funnel which leads to a tubular portion 6 defining a discharge passage extending away from the bottom of a container 4 on which the valve is mounted. The discharge passage has an upper circular cross-section parallel-sided portion 3 having a length determined by the dimensions of a water cooled electrical induction coil 5 located around the tubular portion 6. At a level adjacent to the mid-plane AA of the coil 5 the dicharge passage has an asymmetric outwardly tapering conical portion 7 leading to a lower smaller circular cross-section portion 8. The axis of the portion 8 is offset with respect to the axis of the portion 3, hence the need for the asymmetric conical portion 7. A refractory material centre member 9 having a flat top 10 on a streamlined body 11, is mounted in the conical portion 7, supported by a single web 12 extending from the main body 1, as best seen in FIG. 2. The top 10 of the centre member 9 is circular with the centre of the circle being displaced off the axis of the portion 3, towards the supporting web 12.

The body 11 of the centre member 9 has the form of a cone extending from the circular top 10 to an apex on the axis of the portion 8 of the discharge passage where it joins the conical portion 7. The supporting web 12 has a cross-section of a truncated triangle.

The portion 7 of the discharge passage between the main body 1 and the centre body 9 has a minimum cross-sectional area between the top 10 of the centre member 9 and the wall of the main body 1, the area of this cross-section being just large enough to allow the valve to pass the maximum required flow rate for zero magnetic field from the coil 5. There is also a preferred relationship between the frequency f of the current supplied to the coil 5 and the minimum distance $l_{min}$ between the axis of the portion 3, and the outer edge of the top 10 of the centre member 9, such that:

$$f \geqq 9/\pi\mu\sigma l^2_{min} \quad (1)$$

where $\mu$ is the magnetic permeability of the flowing metal and $\sigma$ its electrical conductivity. Thus, once the frequency has been selected, the minimum diamter of the top 10 of the centre member 9 and the diameter of the passage portion 3, can be calculated. Alternatively, these diameters can be selected and the minimum frequency then calculated.

When the coil 5 is energised so as to produce an induction B at the edge of the flowing metal stream, a magnetic overpressure approximately equal to $B^2/2\mu$ acts on the stream. There is a well known relation, know as Bernoulli's equation, which shows that when the pressure acting on the stream increases, the velocity decreases and vice-versa. If h is the depth of molten metal above the mid-plane AA of the coil 5 then it can be shown that the velocity V, corresponding to an induction B, is related to the velocity $V_o$ for zero field by:

$$\frac{v}{v_0} = \sqrt{1 - \frac{B^2}{2\mu\rho gh}} \quad (2)$$

where $\rho$ is the density of the molten metal and g is the acceleration due to gravity.

Equation (2) is valid so long as the magnetic pressure $B^2/2\mu$ is less than the static pressure $\rho gh$ due to the depth h of the metal. Once the magnetic pressure slightly exceeds the static pressure, the metal will be forced away from the walls of the passage portion 3, and constrained to a region in the centre of the coil 5. As the stream is progressively constrained the flow through the passage portion 7 between the centre member 9 and the main body 1 is gradually cut off by the top 10 of the centre member 9 starting at the edge nearest the supporting web 12, and finishing at the edge furthest from this web. This operation, combined with the shape of the body 11 of the centre member 9, ensures that a single stream issues from the valve for the full range of flow rates. As the flow is throttled, the cross-section of the stream is reduced until it occupies only that part of the passage portion 7 furthest from the web 12. Once the required amount of molten metal has been taken from the container 4 the field strength from the coil 5 is increased rapidly to give a sharp cut off of the flow.

The cirumferential electric currents induced in the molten metal in the discharge passage cause ohmic heating of the metal. Ideally this heating effect should be just sufficient to maintain the metal at the required temperature. However, there are two extreme cases to be considered.

Firstly, if the head of molten metal is low, and the conductivity of the metal is high, the power dissipated in the metal stream is low. These circumstances would occur, for example, when aluminium is dispensed from a shallow launder. The close proximity of the water cooled coil 5 to the valve body 1 can cause a heat loss greater than the heat input to the stream, creating a risk of the metal freezing in the valve. In particular, if the metal stream is shut off for any appreciable length of time the discharge end 8 of the passage could become relatively cold.

This problem can be avoided by making the valve body 1 slightly electrically conducting so that small currents are induced in the valve body 1, particularly in those parts adjacent to the coil 5. As these are also the parts which are most strongly cooled by the water cooled coil 5, the induced currents dissipate heat in just the right regions of the valve body 1 to prevent the metal freezing in the valve. The conductivity of the valve body 1 can be controlled by adding a few percent of graphite or metal powder to the refractory material. Such doping can be varied throughout the valve body 1 to give higher heating rates where required, such as around the discharge end 8 of the passage. Adding graphite or metal powder to the refractory material also increases its thermal conductivty, and hence improves the resistance of the valve body 1 to the thermal shock.

Secondly, if the head of molten metal is high and/or the conductivity of the metal is low, the power dissipated in the metal stream becomes appreciable. These circumstances would occur, for example, when dispensing iron or steel from a tundish. The problem here is to prevent the molten metal superheating in the valve, particularly when the flow rate is low or the flow is shut off. This can be achieved by creating good mixing between the molten metal in the valve and the larger volume of molten metal in the container above.

Figure 1:
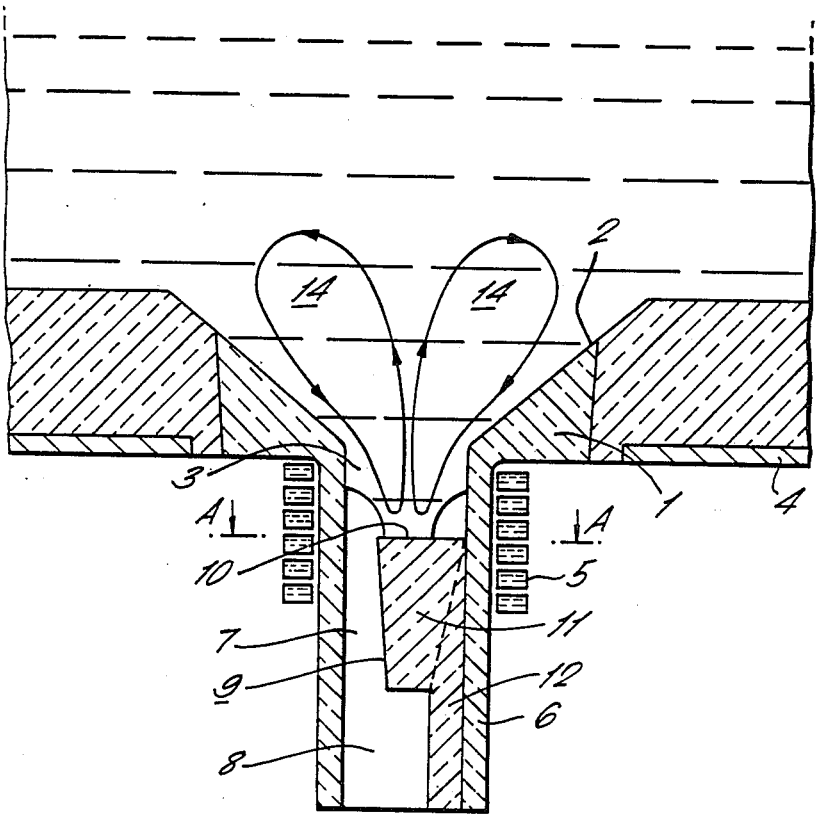
FIG. 1 is a vertical sectional view of a valve according to the invention mounted at the bottom of a container from which molten metal is to be dicharged.

In the valve as described above the electromagnetic forces produce a vigorous mixing action in the column of metal. This action mixes the metal in the column with the bulk of the metal in the container 4 thus greatly reducing the superheating of the column of molten metal. The stirring action arises because the radial electromagnetic forces are greatest on the mid-plane AA of the coil 5 and diminish sharply as the ends of the coil 5 are approached. This distribution of forces drives a ring vortex 14, as illustrated in FIG. 1. To improve the effectiveness of this vortex, it is advantageous for the length of the parallel sided passage portion 3 to be less than the diameter of this portion and for the coil 5 to be similarly short. The funnel surface 2 of the main body 1 serves to maximise the volume of metal entrained by the ring vortex 14 thus improving the mixing of metal between the container and the valve. This mixing is a positive advantage since it stops molten metal freezing in the discharge passage when the stream is shut off.

In one practical embodiment of electromagnetic valve as described above the parallel sided passage portion 3 was 30 mm diameter, and the circular top 10 of the centre member 9 had a diameter of 22 mm which was offset by 2 mm with respect to the axis of the passage portion 3. The passage portion 8 was of 15 mm diameter. The coil 5 was a single turn of water cooled copper placed around the tubular portion 6 of main body 1, so that the mid-plane AA of the coil 5 coincided with the top 10 of the centre member 9.

Figure 3:
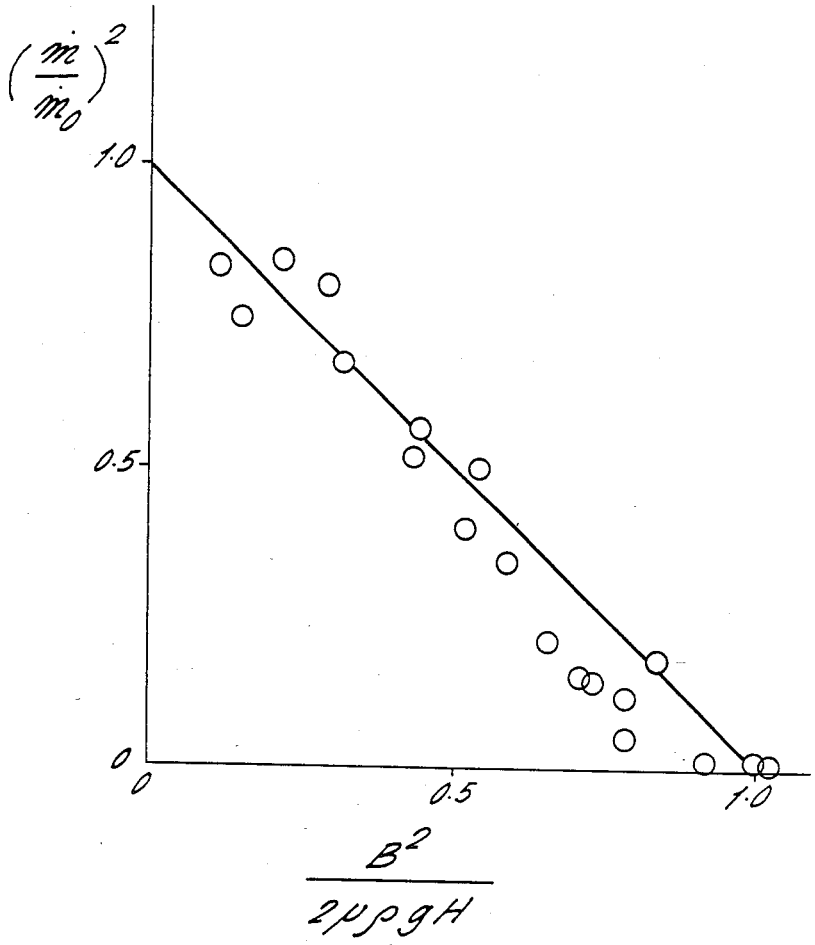
FIG. 3 is a graph illustrating operation of the valve of FIGS. 1 and 2.

Such a valve was tested using aluminium. The mass flow m was measured for various depths of metal h and values of induction B. These values were non-dimensionalised by dividing by $m_o$, the mass flow for zero magnetic field. This ratio squared $(m/m_o)^2$ plotted against $B^2/2\mu\rho gh$ is shown in FIG. 3. As expected from equation 2 this plot is very nearly a straight line of slope $-1$ and the flow is cut off for values of $B^2/2\mu\rho gh$ slightly greater than 1.

Although in the arrangements described above the valve is mounted in the bottom of the container, it can otherwise be mounted in a side wall thereof.

Further, although a water cooled coils 5 is described other coils, for example coils of superconducting material, can otherwise be used.

The valve described above can be used in an automatic metal dispensing system in which the coil current, and hence the flow rate, are regulated by a closed loop control system. The parameter to be controlled, for example, metal flow rate, metal level in a receiving vessel, depth of metal above the top of the centre member in the valve, or weight of metal dispensed, is monitored by a suitable sensor, and the signal froom this sensor is processed electronically to provide an input signal to the power source supplying current to the coil such that the valve delivers the quantity of metal required to maintain the controlled parameter to within a specified tolerance of the set value. The coil current can be varied with time in a predetermined manner so that a specified weight of metal is dispensed.

I claim:

1. An electromagnetic valve for use for discharge of molten metal from a container, comprising a main body providing a discharge passage through which, in use, molten metal will flow from a container under the action of gravity; an electrical induction coil located about the passage; means to supply an alternating electric current to the coil whereby the coil provides an alternating magnetic field which induces electric currents in any moltion metal in the passage; and a centre member located in the passage and shaped such that the passage has an upper circular cross-section parallel sided portion leading to an asymmetric outwardly tapering conical portion which in turn leads to a lower smaller diameter circular cross-section portion the axis of which is offset in relation to that of the upper portion, the centre member having a flat top located at the junction between the upper and conical portions of the passage and being supported by a single web extending from the main body, the arrangement being such that interaction between the magnetic field provided by the coil and the currents induced in the molten metal in the passage provide a force which as it is decreased causes the flow rate of the molten metal through the valve to be reduced until the force is sufficient to urge the molten metal away from the wall of the passage until the molten metal is supported on the flat top of the centre member and the flow of molten metal is cut off.

2. A valve as claimed in claim 1, in which the flat top of the centre member is located substantially at the mid-plane of the coil.

3. A valve as claimed in claim 1, in which the centre of the flat top of the centre member is off set from the axis of the upper portion of the passage in the direction towards the supporting web.

4. A valve as claimed in claim 1, in which the frequency f of the current supplied to the coil and the minimum distance $l_{min}$ between the axis of the upper portion of the passage and the outer edge of the top of the center body satisfies the condition:

$$f \geqq 9/\pi\mu\sigma l^2_{min}$$

where $\mu$ is the magnetic permeability of the molten metal and $\sigma$ its electrical conductivity.

5. A valve as claimed in claim 1, including means to vary the magnitude of the electric current supplied to the coil.

6. A valve as claimed in claim 1, including means to vary the frequency of the electric current supplied to the coil.

7. A valve as claimed in claim 1, in which the coil is water-cooled.

8. A valve as claimed in claim 1, in which the coil is of superconducting material.

9. A valve as claimed in claim 1, in which the body is of refractory material.

10. A valve as claimed in claim 9, in which the wall of the passage is doped with a material which renders the wall electrically conductive.

11. An electromagnetic valve for use for discharge of molten metal from a container, comprising a main body providing a discharge passage through which, in use, molten metal will flow from a container under the action of gravity; an electrical induction coil located about the passage; means to supply an alternating electric current to the coil whereby the coil provides an alternating magnetic field which induces electric currents in any molten metal in the passage; and a centre member located in the passage, the arrangement being such that interaction between the magnetic field provided by the coil and the currents induced in the molten metal in the passage provide a force which as it is increased causes the flow rate of the molten metal through the valve to be reduced until the force is sufficient to urge the molten metal away from the wall of the passage until the molten metal is supported on the top of the centre member and the flow of molten metal is cut off, in which the length of the passage above the top of the center member is less than the diameter thereof, and the passage opens into the container by way of a funnel shaped surface whereby the force provided by the interaction between the magnetic field of the coil and the currents induced in the molten metal, sets up a vortex movement in the molten metal above the center member when the flow is cut off such that the molten metal in the passage is mixed with that in the container.

12. A valve as claimed in claim 11, in which the top of the centre member is located substantially at the mid-plane of the coil.

13. A valve as claimed in claim 11, in which the centre of the top of the centre member is off set from the axis of the passage.

14. A valve as claimed in claim 11, in which the frequency f of the current supplied to the coil and the minimum distance $l_{min}$ between the axis of the passage and the outer edge of the top of the center member satisfies the condition:

$$f \geqq 9/\pi\mu\sigma l^2_{min}$$

where $\mu$ is the magnetic permeability of the molten metal and $\sigma$ its electrical conductivity.

15. A valve as claimed in claim 11, including means to vary the magnitude of the electric current supplied to the coil.

16. A valve as claimed in claim 11, including means to vary the frequency of the electric current supplied to the coil.

17. A valve as claimed in claim 11, in which the coil is water-cooled.

18. A valve as claimed in claim 11, in which the coil is of superconducting material.

19. A valve as claimed in claim 11, in which the body is of refractory material.

20. A valve as claimed in claim 19, in which the wall of the passage is doped with a material which renders the wall electrically conductive.

* * * * *